US006676456B1

(12) United States Patent
Horng

(10) Patent No.: US 6,676,456 B1
(45) Date of Patent: Jan. 13, 2004

(54) SPRING PLATE STRUCTURE

(76) Inventor: Chin Fu Horng, 4F, No. 282 Chung Shan 1st Rd., Lu Chou City, Taipei Hsien (TW)

( * ) Notice: Subject to any disclaimer, the term of this patent is extended or adjusted under 35 U.S.C. 154(b) by 0 days.

(21) Appl. No.: 10/244,664

(22) Filed: Sep. 17, 2002

(30) Foreign Application Priority Data

Aug. 6, 2002 (TW) ..... 91212120 U

(51) Int. Cl.[7] ..... H01R 4/48

(52) U.S. Cl. ..... 439/862

(58) Field of Search ..... 439/862, 83, 816, 439/828, 92

(56) References Cited

U.S. PATENT DOCUMENTS 5,092,783 A * 3/1992 Suarez et al. ..... 439/862
5,746,626 A * 5/1998 Kwiat et al. ..... 439/862
5,857,857 A * 1/1999 Fukuda ..... 439/862

* cited by examiner

*Primary Examiner*—Gary Paumen
(74) *Attorney, Agent, or Firm*—Browdy and Neimark, P.L.L.C.

(57) ABSTRACT

A spring plate structure for use in a motherboard to contact and support an EMI protective shield is constructed having a bottom bonding wall and a top contact wall, a first sidewall fixedly connected between the bottom bonding wall and the top contact wall at one side, a second sidewall obliquely downwardly extended from the top contact wall opposite to the first sidewall and coupled to an endpiece at one side of the bottom bonding wall by a slip joint.

13 Claims, 10 Drawing Sheets

SPRING PLATE STRUCTURE

BACKGROUND OF THE INVENTION

1. Field of the Invention

The present invention relates to a spring plate structure for use in a motherboard to support an EMI protective shield and, more particularly, to such a spring plate structure that has a dead angle design that prevents permanent deformation.

2. Description of the Related Art

In a computer, an electrically conducting sponge may be used with a shield to protect the CPU, data storage devices and other electronic component parts of the motherboard against electromagnetic interference. Due to high manufacturing cost and labor-consuming installation procedure, it is not economic to secure an EMI (electromagnetic interference) protective shield to a motherboard with an electrically conducting sponge. Nowadays, spring plates are commonly used for securing an EMI protective shield to a motherboard. FIGS. 1~5 show a spring plate structure according to the prior art for this purpose. As illustrated, the spring plate structure 60 comprises a top contact wall 61, a bottom bonding wall 63, an intermediate connecting wall 62 obliquely connected between one end the top contact wall 61 and the bottom bonding wall 63, a first chamfer angle R1 connected between the top contact wall 61 and the intermediate connecting wall 62, a second chamfer angle R2 connected between the intermediate connecting wall 62 and the bottom bonding wall 63, an opening 64 formed in the first chamfer angle R1, and a vertical stop wall 65 extended from one lateral side of the top contact wall 61 at right angles and stopped against the top surface of the intermediate connecting wall 62. The spring plate structure 60 has the advantages of high toughness, high electric conductivity, low impedance, and rustless. However, because the left and right sides of the spring plate structure 60 are open sides, the spring plate structure 60 may hook an external body accidentally when the spring plate 60 is connected with the motherboard 80 by tin paste. Further, when received much downward pressure, the spring plate structure 60 tend to be broken, or permanently deformed.

SUMMARY OF THE INVENTION

The present invention has been accomplished to provide a improved spring plate structure, which eliminates the aforesaid drawbacks. It is the main object of the present invention to provide a improved spring plate structure, which does not hook external bodies during loading of the motherboard in which it is installed. It is another object of the present invention to provide a improved spring plate structure, which has a dead angle design that prevents permanent deformation. It is still another object of the present invention to provide a improved spring plate structure, which supports the EMI protective shield stably in position when installed, preventing a contact error.

To achieve these and other objects of the present invention, the spring plate structure comprises a bottom bonding wall, the bottom bonding wall having a first side and a second side; a first sidewall obliquely upwardly extended from the first side of the bottom bonding wall, the first sidewall having a bottom side connected to the first side of the bottom bonding wall and a top side; a top contact wall suspended above and arranged in parallel to the bottom bonding wall, the top contact wall having a first side connected to the top side of the first sidewall and a second side, the area of the top contact wall being smaller than the bottom bonding wall; a second sidewall obliquely downwardly extended from the second side of the top contact wall, the second sidewall having a top side connected to the second side of the top contact wall, a bottom side, and a longitudinal sliding slot spaced between the top side and bottom side of the second sidewall on the middle; and a first endpiece upwardly extended from the second side of the bottom bonding wall below the elevation of the second sidewall, the first endpiece having a fixed end connected to the second side of the bottom bonding wall and a free end terminating in a hooked portion hooked in the longitudinal sliding slot of the second sidewall for enabling the second sidewall to be moved vertically relative to the bottom bonding wall within a distance.

DETAILED DESCRIPTION OF THE PREFERRED EMBODIMENT

Figure 1:
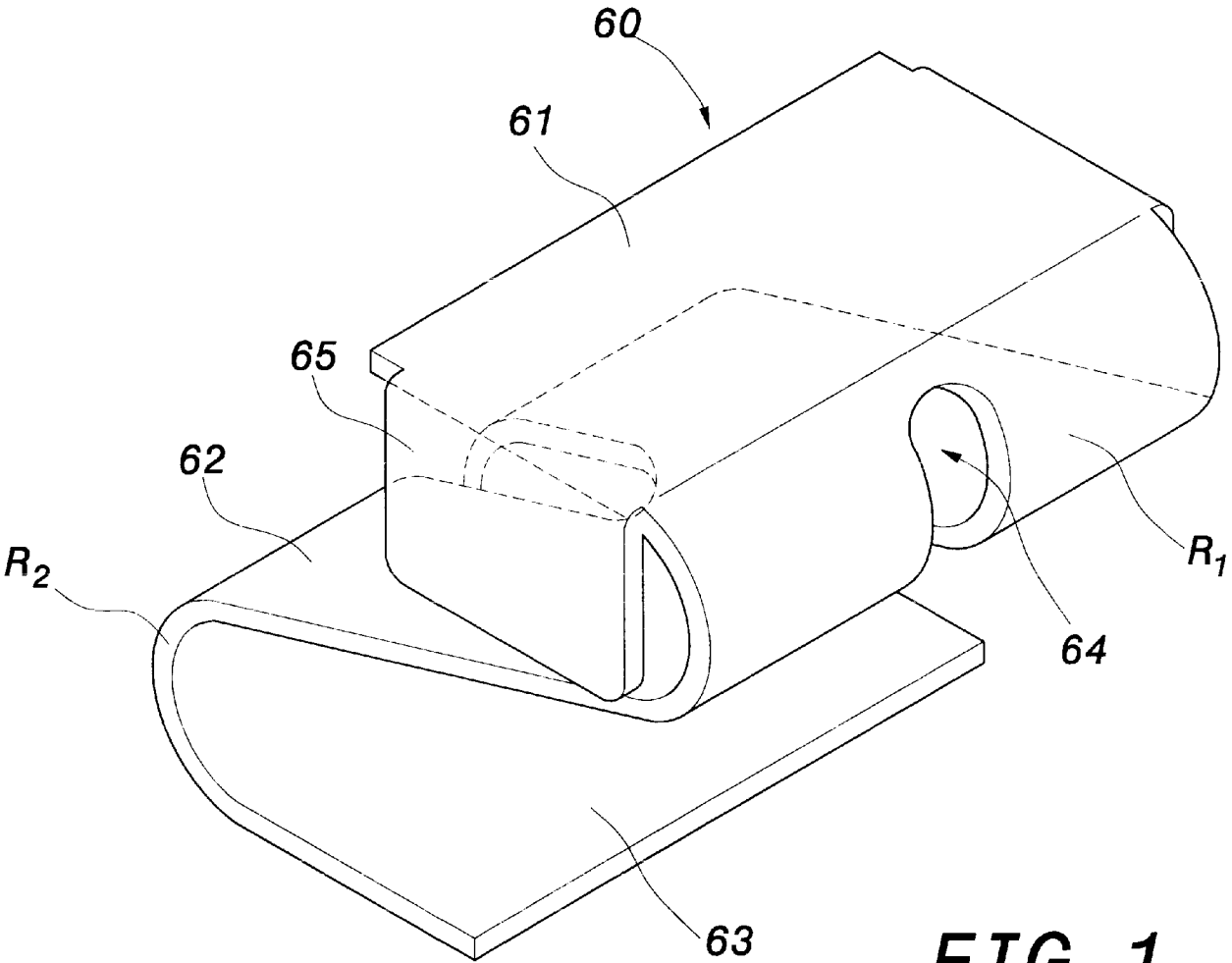
FIG. 1 PRIOR ART
FIG. 1 is a perspective view of a spring plate structure according to the prior art.
Figure 2:
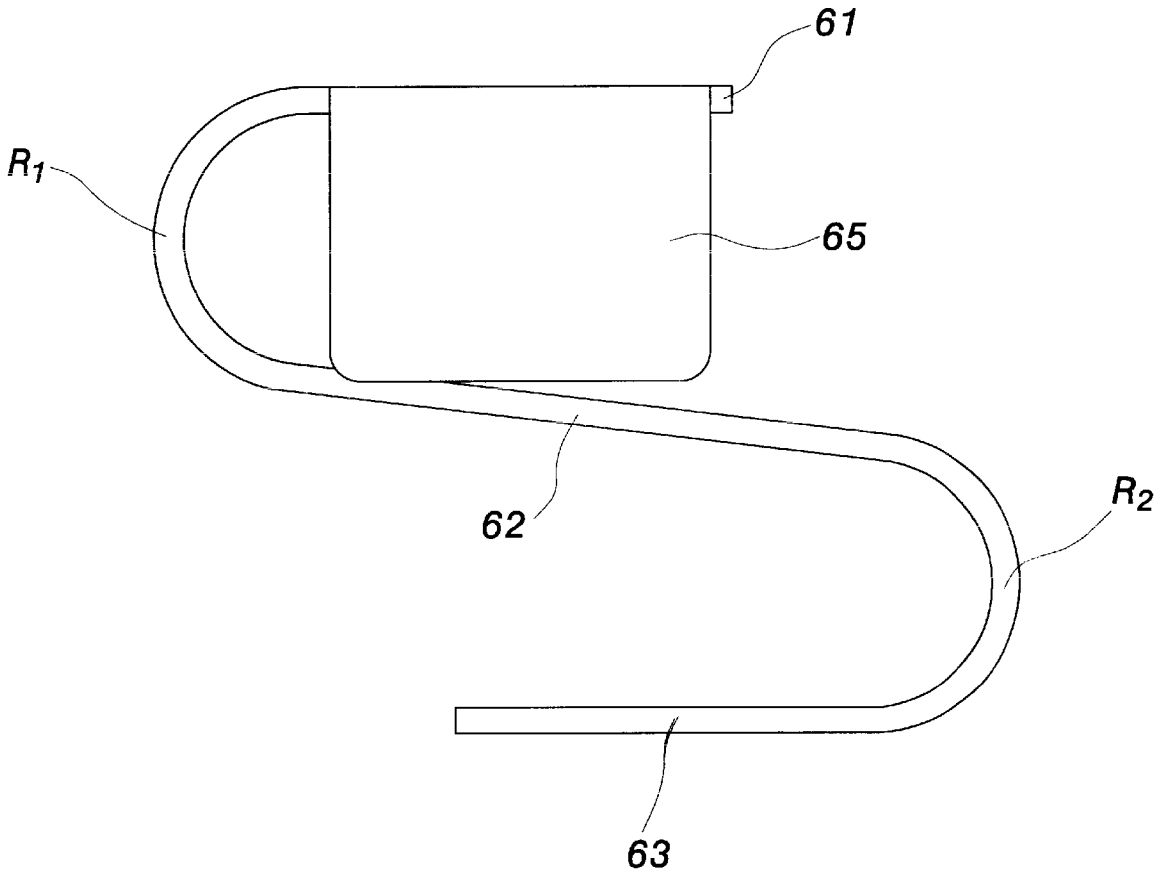
FIG. 2 PRIOR ART
FIG. 2 is a front view of the spring plate structure according to the prior art.
Figure 3:
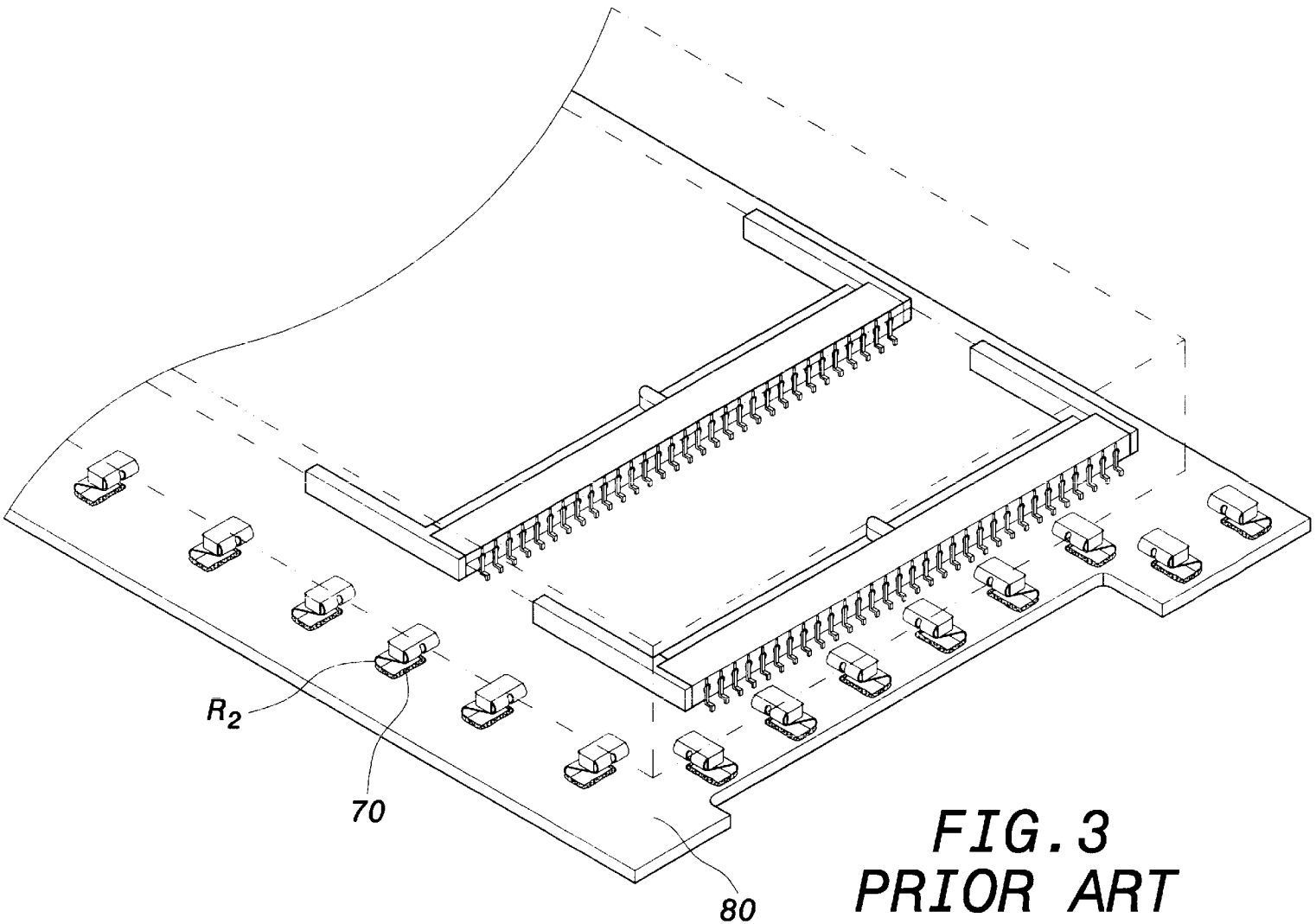
FIG. 3 PRIOR ART
FIG. 3 shows an application example of the prior art design.
Figure 4:
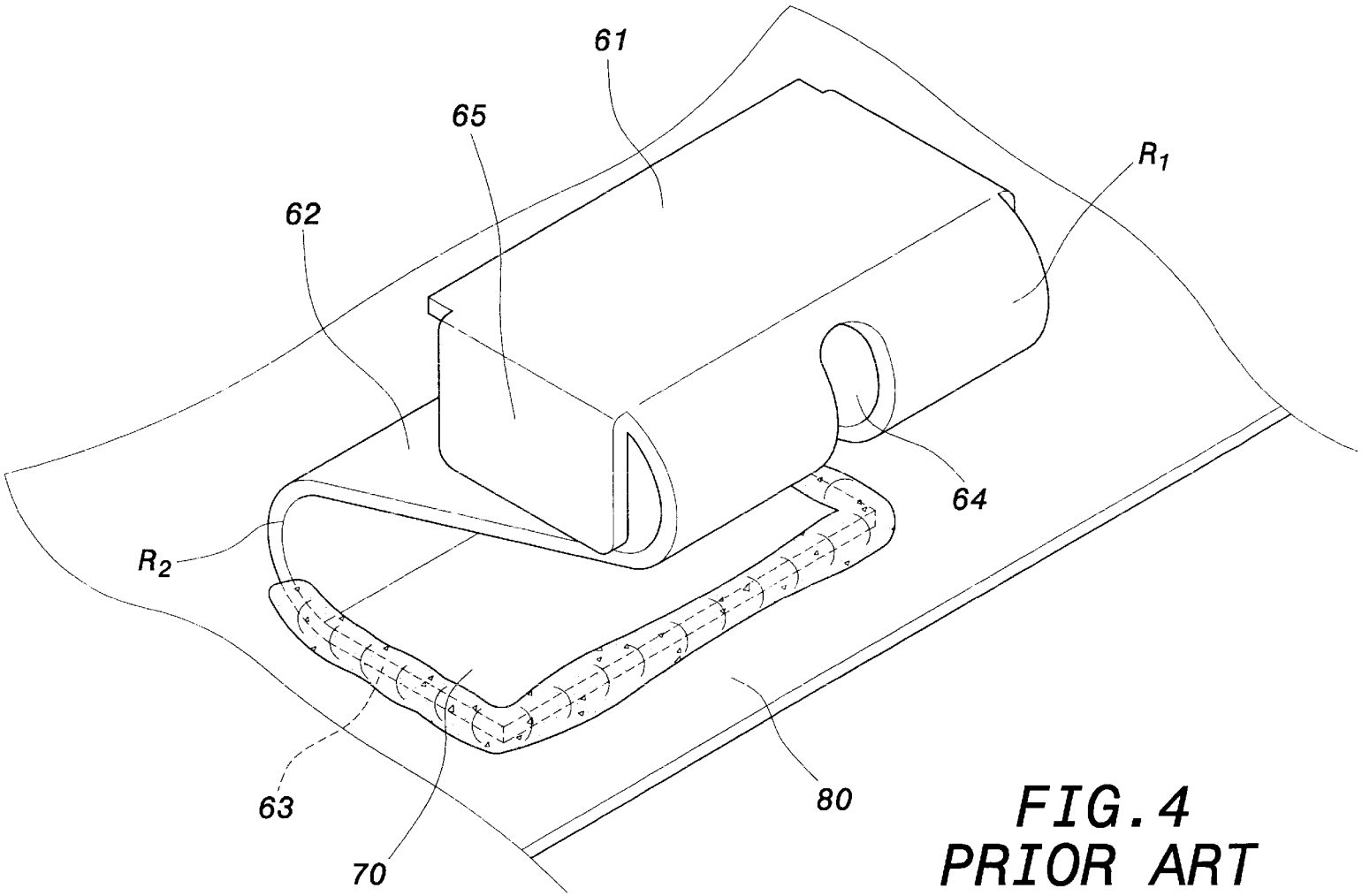
FIG. 4 PRIOR ART
FIG. 4 illustrates the bottom bonding wall of the spring plate structure bonded to a motherboard with tin paste according to the prior art.
Figure 5:
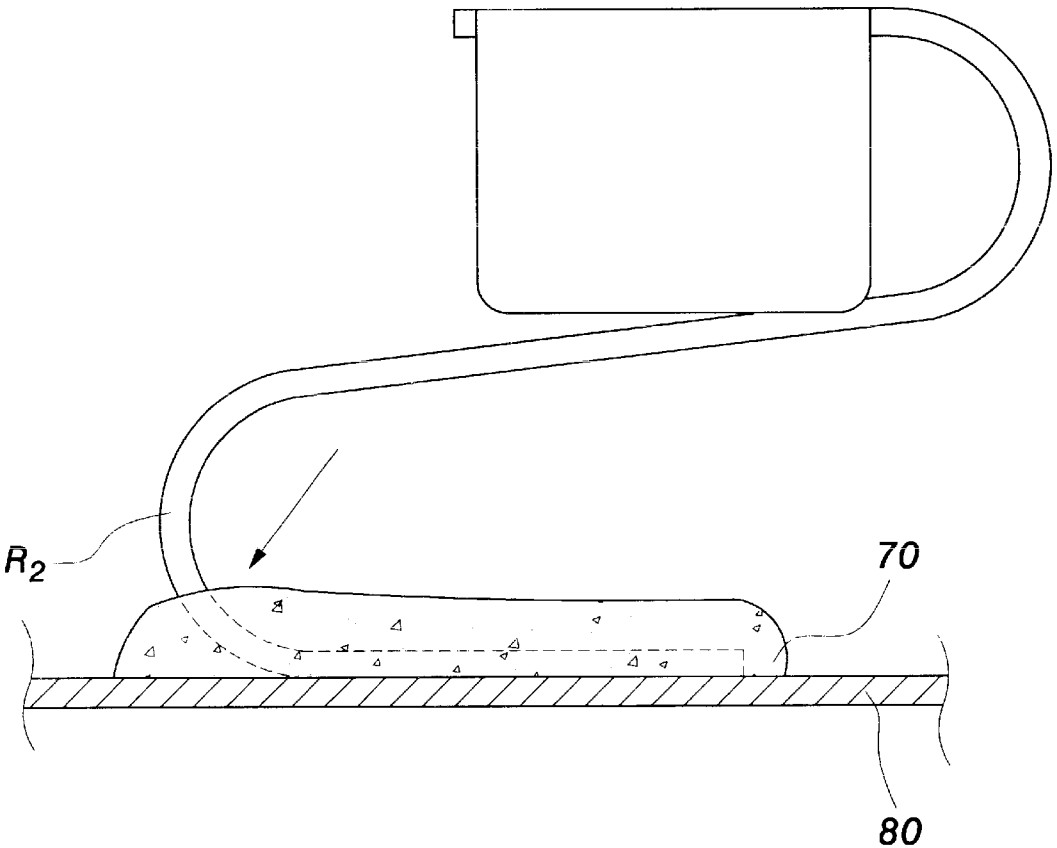
FIG. 5 PRIOR ART
FIG. 5 is a front view of FIG. 4.
Figure 6:
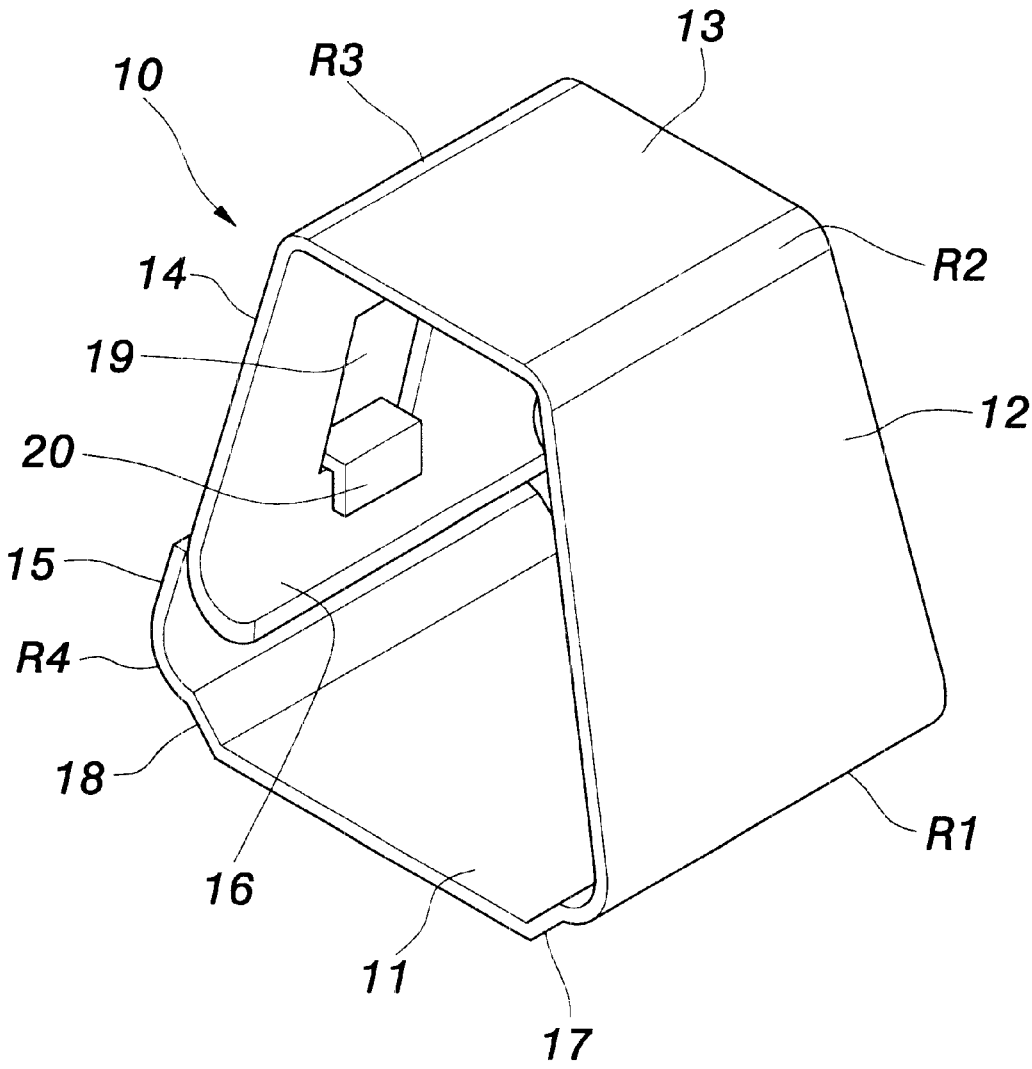
FIG. 6 is an elevational view of a spring plate structure according to the present invention.
Figure 8:
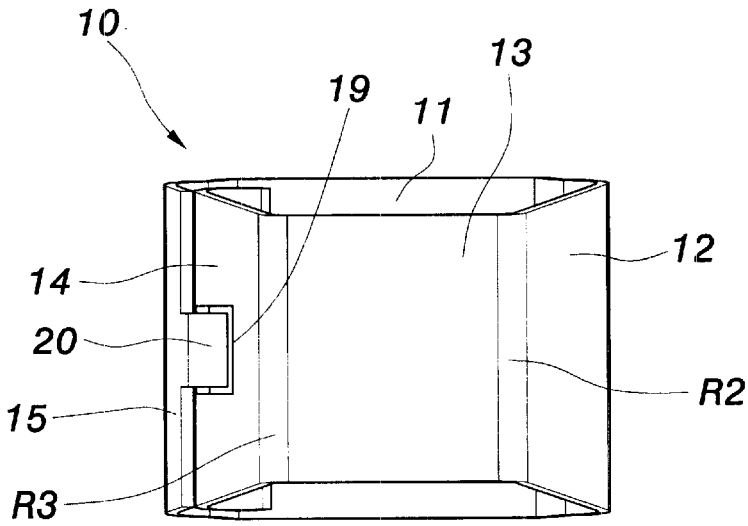
FIG. 8 is a top view of the spring plate structure according to the present invention.
Figure 7:
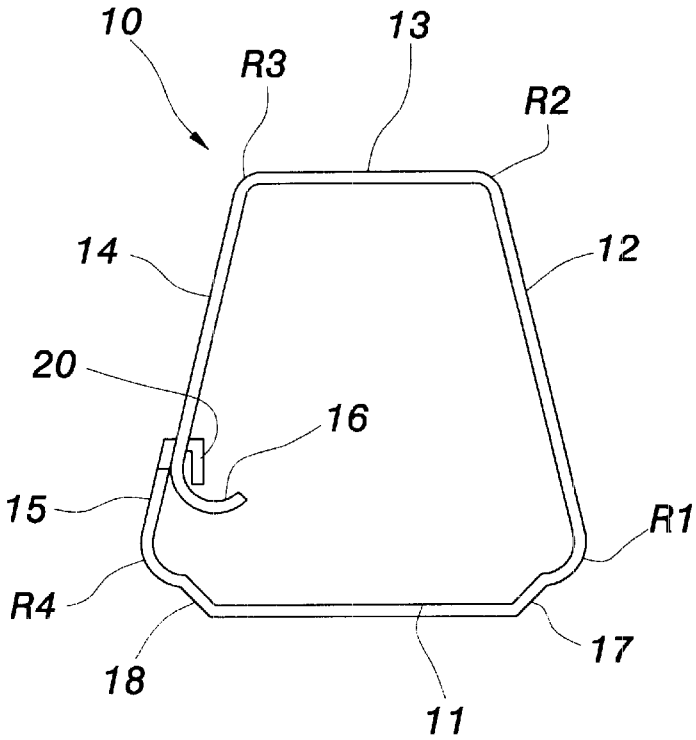
FIG. 7 is a front view of the spring plate structure according to the present invention.

Referring to FIGS. 6, 7, and 8, a spring plate structure 10 is made by bending a metal plate into shape, having one end terminating in a first endpiece 15 and the other end terminating in a second endpiece 16, a bottom bonding wall 11 and a top contact wall 13 connected in series between the first endpiece 15 and the second endpiece 16 and arranged in parallel at different elevations, a first sidewall 12 obliquely connected between the bottom bonding wall 11 and the top contact wall 13 at one side, a second sidewall 14 obliquely connected between the top contact wall 13 and the second endpiece 16.

The bottom bonding wall 11 is a horizontal wall for soldering to the motherboard with tin paste, having a first sloping portion 17 upwardly outwardly extended from one side and terminating in one side of the first sidewall 12 and a second sloping portion 18 upwardly outwardly extended from the other side and terminating in one side of the first endpiece 15.

The first sidewall 12 slopes upwardly inwards from the bottom bonding wall 11 toward the top contact wall 13. A first chamfer angle R1 is provided between the bottom side of the first sidewall 12 and the first sloping portion 17 of the bottom bonding wall 11.

The top contact wall 13 is a horizontal wall adapted to support and contact an EMI (electromagnetic interference) protective shield. The area of the top contact wall 13 is smaller than the bottom bonding wall 11. A second chamfer angle R2 is provided between the right side of the top contact wall 13 and the top side of the first sidewall 12.

The second sidewall 14 is suspended above the bottom bonding wall 11 and connected between the left side of the top contact wall 13 and the second endpiece 16, having a longitudinal sliding slot 19 on the middle. A third chamfer angle R3 is provided between the left side of the top contact wall 13 and the top side of the second sidewall 14.

The first endpiece 15 is disposed below the elevation of the second sidewall 14 and spaced from the second endpiece 16 at an outer side. A fourth chamfer angle R4 is provided between the first endpiece 15 and the second sloping portion 18 of the bottom bonding wall 11. The free end of the first endpiece 15 is disposed in contact with the outer surface of the bottom side of the second sidewall 14. Further, the first endpiece 15 has a ⊓-shaped hooked portion 20 protruded from the free end and hooked in the longitudinal sliding slot 19 of the second sidewall 14 to guide vertical movement of the second sidewall 14 relative to the bottom bonding wall 11 and to limit the range of the movement. The hooked portion 20 and the sliding slot 19 forms a slip joint that joins the first endpiece 15 and the second sidewall 14.

The second endpiece 16 has a smoothly arched cross-section. One side of the second endpiece 16 is a fixed end terminating in the bottom side of the second sidewall 14. The other side of the second endpiece 16 is a free end facing the inner side of the fourth chamfer angle R4.

Figure 9:
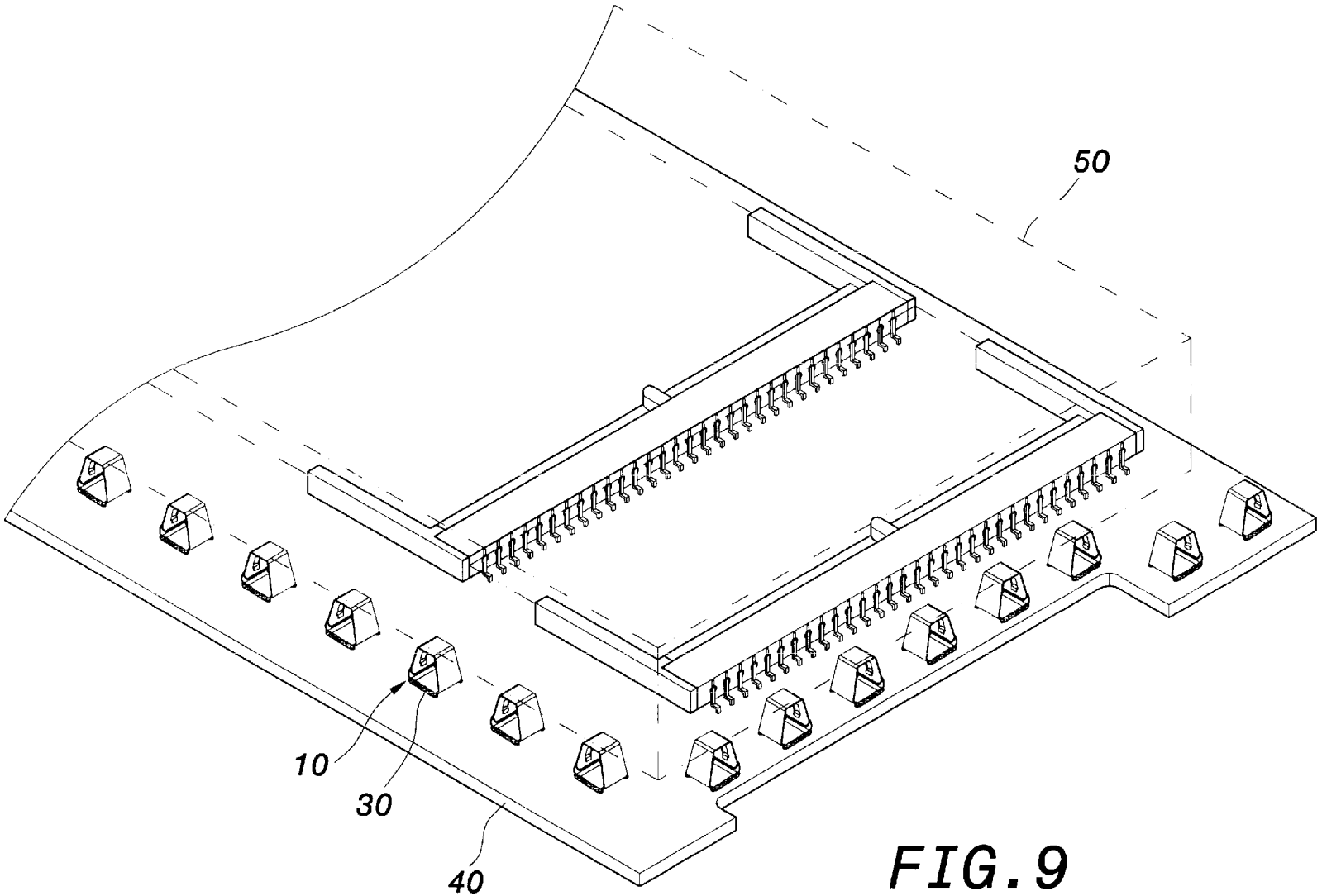
FIG. 9 is an applied view of the present invention, showing a number of spring plates structure bonded to the border area of a motherboard.
Figure 10:
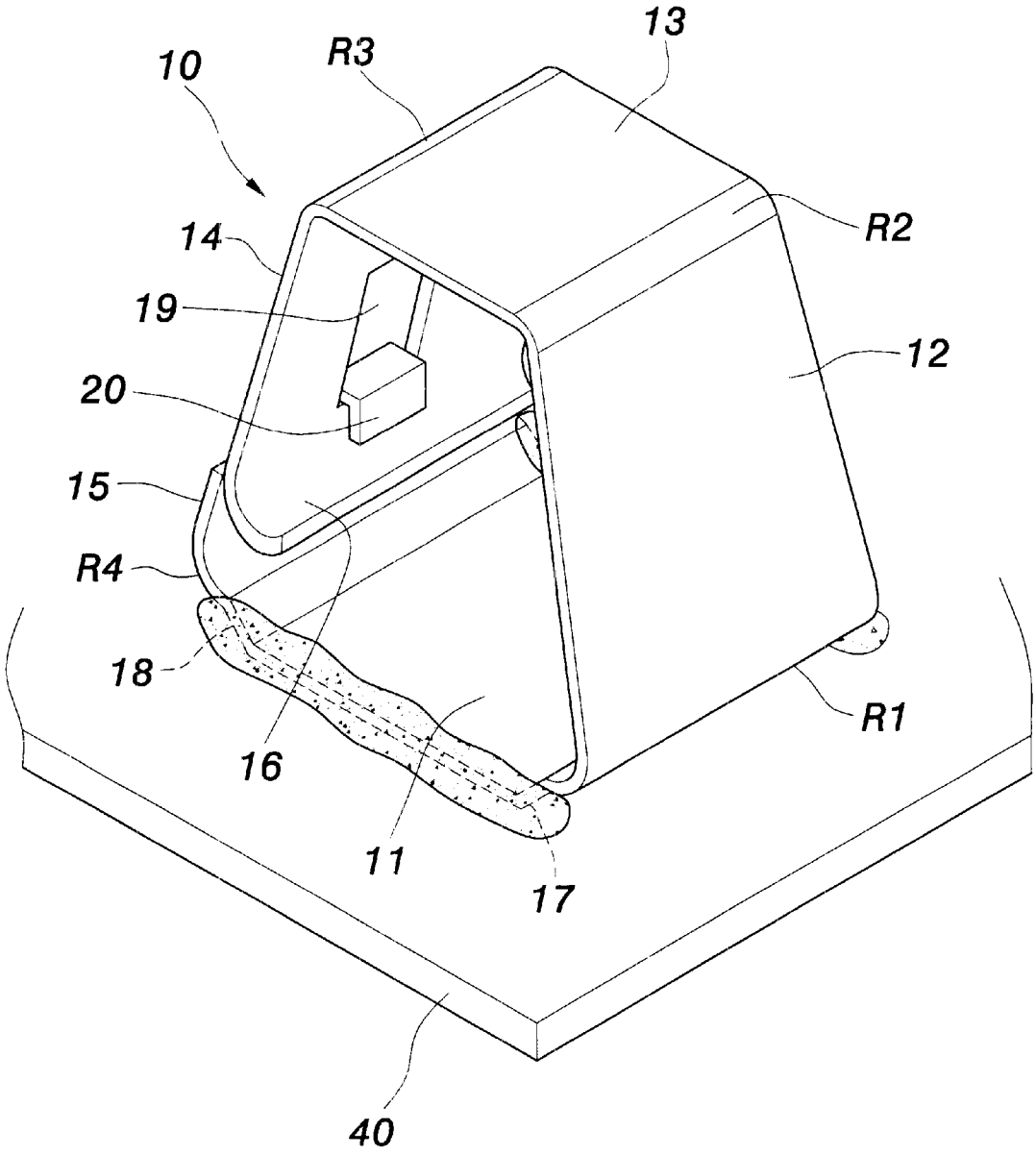
FIG. 10 is a perspective view of the present invention, showing the bottom bonding wall of the spring plate structure bonded to the motherboard with tin paste.
Figure 11:
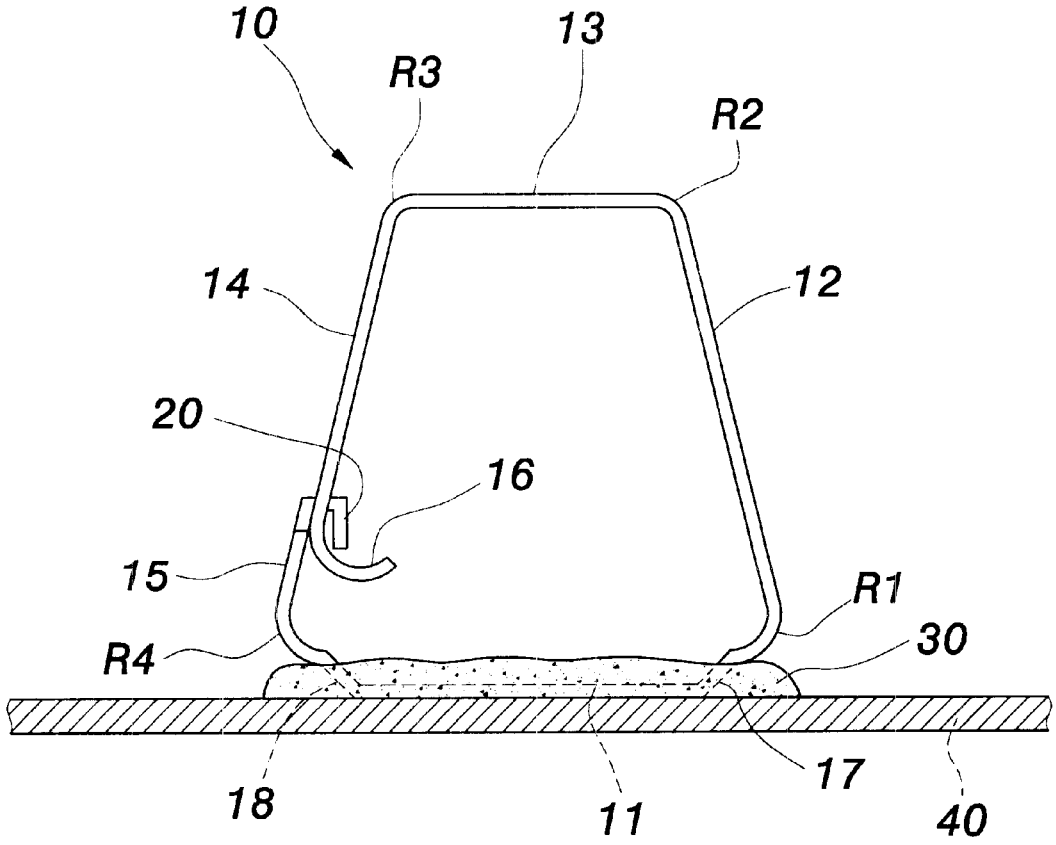
FIG. 11 is a front view of FIG. 10.

Referring to FIGS. 9~11, a plurality of spring plate structures 10 are respectively bonded to a motherboard 40 around the border area to support an EMI protective shield 50. By means of the bottom bonding wall 11, each spring plate structure 10 is soldered to the motherboard 40 with tin paste 30. Therefore, when installed, the spring plate structures 10 are well grounded. When the spring plate structures 10 forced downwards by the EMI protective shield 50, the first sloping portion 17 and second sloping portion 18 of each spring plate structure 10 drive accumulated stress away from tin paste 30 and the first chamfer angle R1 and fourth chamfer angle R4 of the respective spring plate structure 10. Further, when the top contact wall 13 of each spring plate structure 10 received a downward pressure from the EMI protective shield 50, the second endpiece 16 is lowered with the second sidewall 14 to the lower limit position and stopped at the inner surface of the fourth chamfer angle R4 to limit the downward movement of the second sidewall 14, preventing permanent deformation of the respective spring plate structure 10.

As indicated above, the present invention provides a spring plate, which has chamfer angles to drive away accumulated stress, and two distal ends coupled together through a slip joint to prevent permanent deformation during the use.

A prototype of spring plate has been constructed with the features of FIGS. 6~11. The spring plate functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A spring plate structure comprising a bottom bonding wall, said bottom bonding wall having a first side and a second side;

a first sidewall obliquely upwardly extended from the first side of said bottom bonding wall, said first sidewall having a bottom side connected to the first side of said bottom bonding wall and a top side;

a top contact wall suspended above and arranged in parallel to said bottom bonding wall, said top contact wall having a first side connected to the top side of said first sidewall and a second side, the area of said top contact wall being smaller than said bottom bonding wall;

a second sidewall obliquely downwardly extended from the second side of said top contact wall, said second sidewall having a top side connected to the second side of said top contact wall, a bottom side, and a longitudinal sliding slot spaced between the top side and bottom side of said second sidewall on the middle; and a first endpiece upwardly extended from the second side of said bottom bonding wall below the elevation of said second sidewall, said first endpiece having a fixed end connected to the second side of said bottom bonding wall and a free end terminating in a hooked portion hooked in the longitudinal sliding slot of said second sidewall for enabling said second sidewall to be moved vertically relative to said bottom bonding wall within a distance.

2. The spring plate structure as claimed in claim 1, wherein said spring plate is formed of a metal plate in integrity.

3. The spring plate structure as claimed in claim 1, wherein said bottom bonding wall is a horizontal wall.

4. The spring plate structure as claimed in claim 1, wherein said bottom bonding wall has a first sloping portion and a second sloping portion upwardly outwardly extended from the first and second sides thereof, said first sloping portion being connected to the bottom side of said first sidewall.

5. The spring plate structure as claimed in claim 4, further comprising a chamfer angle connected between said first sloping portion of said bottom bonding wall and the bottom side of said first sidewall.

6. The spring plate structure as claimed in claim 4, wherein the fixed end of said endpiece is connected to the second sloping portion of said bottom bonding wall.

7. The spring plate structure as claimed in claim 4, further comprising a chamfer angle connected between the second sloping portion of said bottom bonding wall and the fixed end of said first endpiece.

8. The spring plate structure as claimed in claim 1, wherein said first sidewall and said second sidewall are respectively sloping upwardly inwards in direction from said bottom bonding wall toward said top contact wall.

9. The spring plate structure as claimed in claim 1, wherein said top contact wall is a horizontal wall.

10. The spring plate structure as claimed in claim 1, further comprising a chamfer angle connected between the top side of said first sidewall and the first side of said top contact wall.

11. The spring plate structure as claimed in claim 1, further comprising a chamfer angle connected between the top side of said second sidewall and the second side of said top contact wall.

12. The spring plate structure as claimed in claim 1, wherein said first endpiece slopes upwardly inwards in direction from the second sloping portion of said bottom bonding wall toward the bottom side of said second sidewall.

13. The spring plate structure as claimed in claim 1, further comprising a second endpiece, said second endpiece having a smoothly arched cross-section, a fixed end connected to the bottom side of said second sidewall and a free end facing the fixed end of said first endpiece.

* * * * *